US008833109B2

(12) United States Patent
Kim et al.

(10) Patent No.: US 8,833,109 B2
(45) Date of Patent: Sep. 16, 2014

(54) HOME APPLIANCE

(75) Inventors: Youngjong Kim, Changwon-si (KR); Changwoo Son, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1082 days.

(21) Appl. No.: 12/847,478

(22) Filed: Jul. 30, 2010

(65) Prior Publication Data

US 2011/0048079 A1 Mar. 3, 2011

Related U.S. Application Data

(60) Provisional application No. 61/230,555, filed on Jul. 31, 2009.

(30) Foreign Application Priority Data

Jul. 31, 2009 (KR) ..... 10-2009-0071052

(51) Int. Cl.
*D06F 35/00* (2006.01)
*D06F 33/02* (2006.01)
*D06F 37/42* (2006.01)

(52) U.S. Cl.
CPC ..... *D06F 37/42* (2013.01); *D06F 2212/06* (2013.01); *D06F 2202/12* (2013.01); *D06F 33/02* (2013.01); *D06F 2204/06* (2013.01); *D06F 2224/00* (2013.01)
USPC ..... 68/13 R; 68/3 R

(58) Field of Classification Search
USPC ..... 68/3 R, 13 R
See application file for complete search history.

(56) References Cited

U.S. PATENT DOCUMENTS

| | | | | |
|---|---|---|---|---|
| 4,937,728 | A * | 6/1990 | Leonardi | 363/97 |
| 5,852,550 | A * | 12/1998 | Majid et al. | 363/21.05 |
| RE37,360 | E * | 9/2001 | Duncan | 318/281 |
| 6,909,616 | B2 * | 6/2005 | Kim | 363/16 |
| 7,002,814 | B2 * | 2/2006 | Kim et al. | 363/21.15 |
| 2004/0052093 | A1 * | 3/2004 | Kim | 363/21.01 |
| 2008/0098615 | A1 * | 5/2008 | Kim | 34/493 |

* cited by examiner

*Primary Examiner* — Michael Barr
*Assistant Examiner* — Benjamin L Osterhout
(74) *Attorney, Agent, or Firm* — Birch, Stewart, Kolasch & Birch, LLP

(57) ABSTRACT

A home appliance that has increased accuracy and sensing speed of a cord-off compared to a voltage detecting method using a RMS value of commercial AC and thus may quickly perform subsequent operations for user's safety and convenience is provided.

9 Claims, 5 Drawing Sheets

HOME APPLIANCE

CROSS-REFERENCE TO RELATED APPLICATION

This application claims the priority benefit of Korean Patent Application No. 10-2009-0071052, filed on Jul. 31, 2009 in the Korean Intellectual Property Office and U.S. Provisional Patent Application No. 61/230,555 filed on Jul. 31, 2009, the disclosure of which is incorporated herein by reference.

BACKGROUND OF THE INVENTION

1. Technical Field

This disclosure is directed to a home appliance, and more particularly, to a home appliance having a motor, such as a washing machine, which quickly and exactly senses occurrence of a cord-off or a power failure to perform subsequent operations for user's safety and convenience.

2. Discussion of the Related Art

A home appliance, such as a washing machine, includes a motor that rotates at high speed a washing tub containing laundry. While the motor operates, the home appliance closes a door so that a user cannot put a hand in the washing tub, or stops rotation of the washing tub.

When a cord-off, which, for example, means unplugging of a cord while the washing tub rotates at high speed, or a power failure occurs, the door should be able to be open so that the user may take the laundry out of the washing tub, and the rotational speed of the washing tub should be reduced or the rotation of the washing tub should be stopped.

Under the situation of occurrence of the cord-off, the subsequent operations should be performed before available power is completely removed considering user's safety and convenience.

Accordingly, the home appliance needs to quickly and exactly determine a time point when the cord-off (or power failure) occurred.

The home appliance, such as a washing machine, should control a motor of high power consumption to reduce the rotational speed of the motor and simultaneously allows the door to be able to be open. Thus, late determination of a time point when a cord-off (or power failure) occurred may render it difficult to perform subsequent operations.

SUMMARY OF THE INVENTION

Exemplary embodiments of the present invention provide a home appliance that determines a time point when a cord-off (or power failure) occurs based on characteristics of pulses included in commercial AC, which repeat in a constant period and performs subsequent operations for user's safety and convenience.

According to an embodiment of the present invention, there is provided a home appliance of treating laundry contained in a washing tub, comprising a cord-off sensing unit that generates a plurality of sensing signals corresponding to a pulse of commercial AC, and a controller that determines that a cord-off occurs when a pulse train including the sensing signals is not detected within a predetermined reference time.

The home appliance configured as above according to the exemplary embodiments of the present invention may quickly and exactly determine whether a cord-off (or power failure) occurs compared to a method of using a RMS value of commercial AC and perform subsequent operations according to the cord-off (or power failure).

Further, the home appliance according to the exemplary embodiments of the present invention does not determine whether a cord-off occurs based on change in voltage of the commercial AC, thus minimizing unnecessary malfunctions.

DETAILED DESCRIPTION OF THE PREFERRED EMBODIMENTS

An embodiment of the present invention applies to any home appliances driven by a motor. The home appliances according to the embodiments of the present invention may quickly and exactly detect occurrence of a cord-off or a power failure that refers to cutoff of supply of commercial AC while driven by the commercial AC to protect a user, and may perform operations subsequent to the occurrence of the cord-off (or power failure).

Although the description of the present invention primarily focuses on a washing machine having a strong rotational force among home appliances, the present invention is not limited thereto.

Throughout the specification, the term "cord-off" refers to cut-off of power supply occurring upon unplugging a power cord supplying commercial AC to a home appliance. The "subsequent operations" include operations of stopping a motor driven in the washing machine, reducing the rotational speed of the motor, or, after the cord-off, leaving a door of a washing tub open to allow a user to take laundry out of the washing tub.

Hereinafter, exemplary embodiments of the present invention will be described in greater detail with reference to the accompanying drawings.

Figure 1:
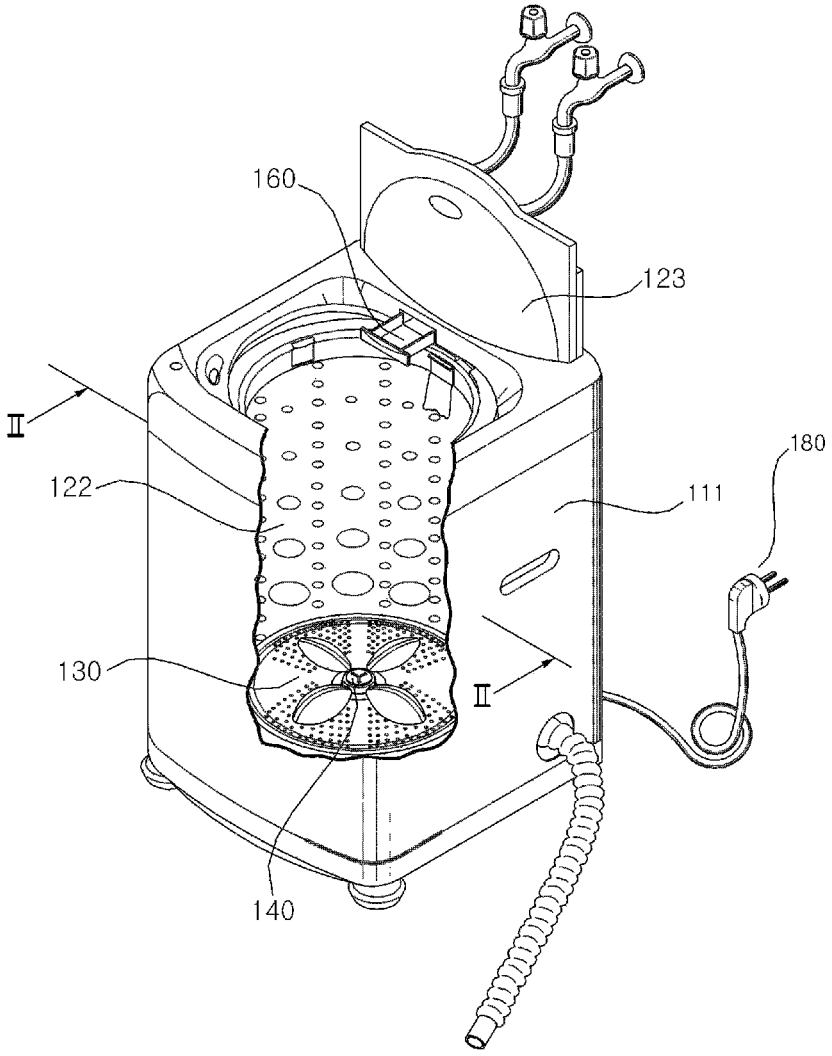
FIG. 1 is a perspective view illustrating a washing machine according to an embodiment of the present invention.
Figure 2:
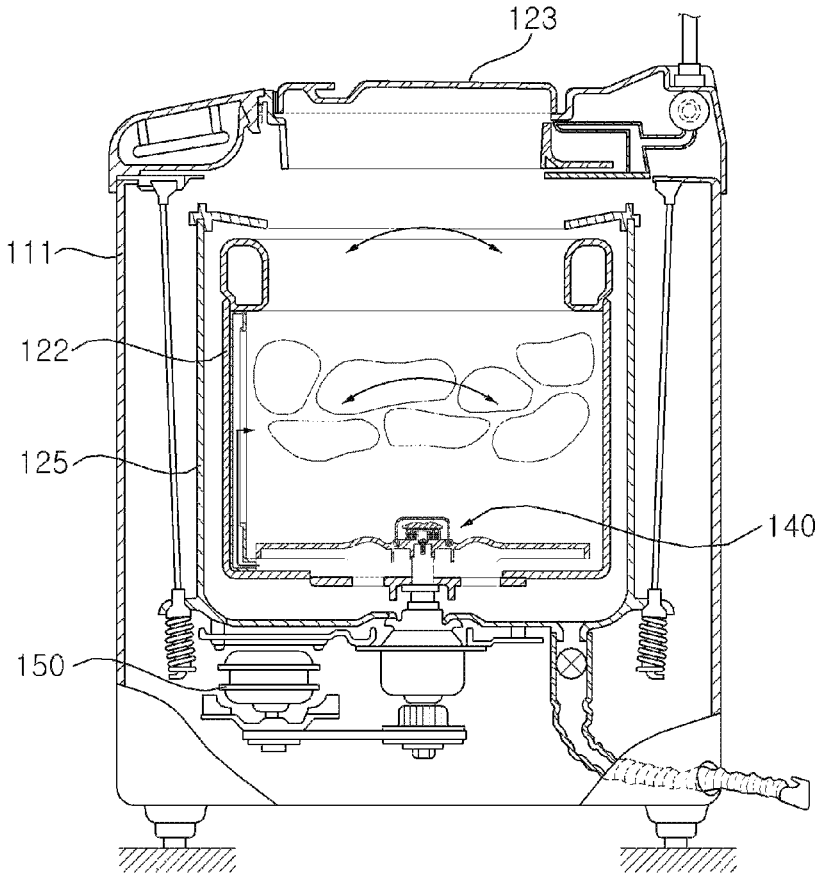
FIG. 2 is a cross-sectional view taken along line II-II of FIG. 1.

FIG. 1 is a perspective view illustrating a washing machine 100 according to an embodiment of the present invention, and FIG. 2 is a cross-sectional view taken along line II-II of FIG. 1.

Referring to FIGS. 1 and 2, the washing machine 100 includes a cabinet 110, a water container 125, a water supply unit (not shown), a washing tub 122, a driving unit 150, a fabric conditioner sprayer W, and a drainage unit (not shown). The water container 125 is arranged in the cabinet 110 to store wash water supplied from an external source (not shown). The water supply unit supplies wash water from an external source (not shown) located outside the cabinet 110 to the water container 125. The washing tub 122 is arranged in the water container 125 to contain the laundry. The washing tub 122 rotates to wash the laundry. The driving unit 150 generates a driving force that rotates the washing tub 122 and transfers the driving force to the washing tub 122. Upon laundering, the fabric conditioner sprayer W mixes a fabric conditioner with wash water supplied from the external source and supplies the mixed water to the water container 125 and the washing tub 122. The drainage unit discharges the used wash water from the water container 125 when laundering is complete.

The cabinet 110 includes a cabinet body 111 having an opening, a base (not shown) that is arranged at a lower side of the cabinet body 111 and connected to the cabinet body 111, a door 123 that is rotatably connected to a side of the cabinet body 111 to open and close the opening, an input unit (not shown) that is arranged at a side of the door 123 to receive an external signal from a user, and a control panel (not shown) connected to the cabinet body 111.

Figure 3:
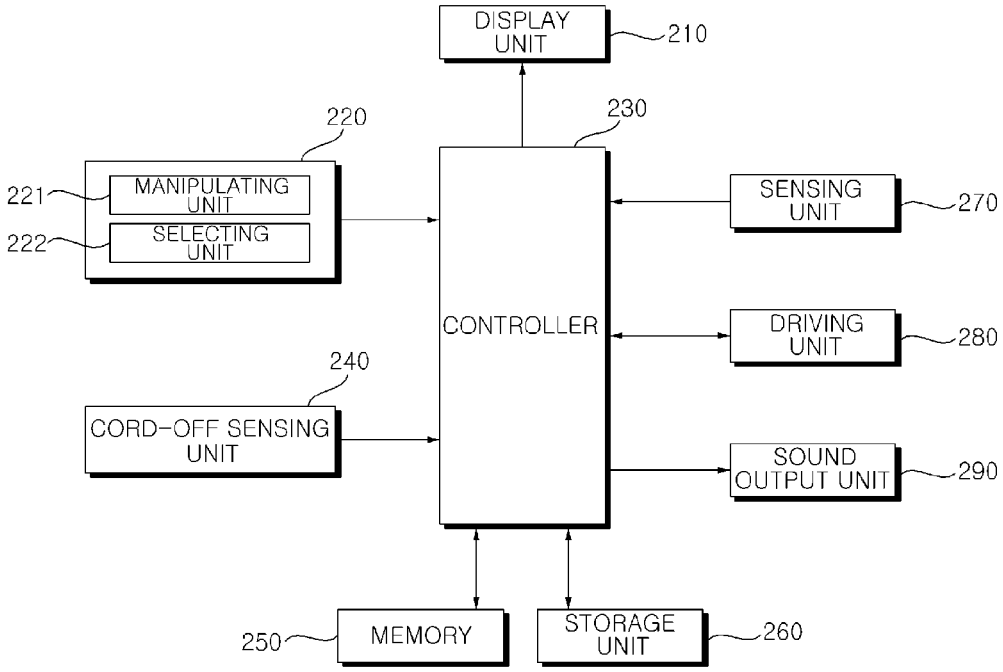
FIG. 3 is a block diagram illustrating a control device included in the washing machine 100 shown in FIG. 1.

FIG. 3 is a block diagram illustrating a control device included in the washing machine 100 shown in FIG. 1.

The control device includes an input unit 220, a sensing unit 270, a memory 250, a storage unit 260, a driving unit 280, a sound output unit 290, and a controller 230. The controller 230 controls the overall operation of the washing machine 100. The control device may further include a display unit 210 as shown in FIG. 3.

The input unit 220 includes at least one input means that inputs a predetermined signal or data to the washing machine 100 according to user's manipulation. The input unit 220 may include a manipulating unit 221 and a selecting unit 222.

The manipulating unit 221 receives data, such as data on operating courses or operating setups, and applies the data to the controller 230 according to the operation of the washing machine 100. The input unit 220 may include, but not limited to, a button, a dome switch, a touchpad (resistive-type/capacitive-type), a jog wheel, a jog switch, a finger mouse, a rotary switch, or a jog dial. Any devices that may generate predetermined input data by user's manipulation, such as pushing, rotating, pressurizing, or contacting, may be used as the input unit 220.

The selecting unit 222 includes at least one input means. The selecting unit 222 applies a signal output command to the controller 230 so that product information is outputted as a predetermined sound by the sound output unit 290 when a smart monitoring mode is selected by the input means.

Each of the selecting unit 222 and the manipulating unit 221 may be implemented as a separate input means. According to an embodiment, two or more manipulating units may be provided, and the two or more manipulating units are simultaneously manipulated to operate as the selecting unit 222 or to be recognized as the selecting unit 222. Also, the selecting unit 222 may be manipulated continuously or more than a predetermined time to operate as the selecting unit 222 or to be recognized as the selecting unit 222.

The sensing unit 270 includes at least one sensing means that senses a temperature, a pressure, a voltage, a current, a water level, or the number of rotations, such as a RPM (Revolutions Per Minute). The sensing unit 270 transmits sensed or measured data to the controller 230. For example, the sensing unit 270 measures the water level upon supply or drainage in the washing machine 100 and measures the temperature of supplied water or rotational speed of a washing tub or drum.

The driving unit 280 controls the washing machine 100 so that the washing machine 100 may perform preset operations in response to a control command received from the controller 230. Accordingly, the washing machine 100 performs a series of cycles, such as a washing cycle, a rinsing cycle, and a dehydrating cycle, to get rid of contaminants from the laundry.

For example, in the washing machine 100, the driving unit 280 drives and controls the operation of a motor that rotates the washing tub or drum to remove contaminants from the laundry. Further, in response to a control command, the driving unit 280 controls valves to perform water supply or drainage.

The memory 250 may include a data storage means, such as, for example, a ROM or EEPROM for storing control data for the washing machine 100 and a storage area for storing data generated by treating a process. The storage unit 260 is a buffer for the controller 230 and includes a storage means that temporarily stores data, such as, for example, a DRAM or SRAM. As necessary, the storage unit 260 may be included in the controller 230 or the memory 250.

The memory 250 stores operational state data generated when the washing machine 100 performs a predetermined operation, operation information, such as setup data inputted by the manipulating unit 221 so that the washing machine 100 may perform a predetermined operation, usage information, such as the number of times of specific operation performed by the washing machine 100 or model information of the washing machine 100, and failure information, such as information on cause or location of malfunction of the washing machine 100.

Also, the memory 250 stores product information including the operation information, the usage information, and the failure information. The storage unit 260 also stores temporary data on the operation information and the failure information generated during operation. For example, the product information of the washing machine 100 may include a number of times of use of the washing machine 100, a setup course, optional setup information, an error code, a sensor-measured value, data produced by the controller 230, and operation data of each component.

The operation information may include information necessary for operation of the washing machine 100, such as information on the washing cycle of the washing machine 100, information on the dehydrating cycle, and information on the rinsing cycle.

Further, the failure information may include various types of information, such as information on a failure occurring while the washing machine 100 performs each operation, information on a failure of the washing machine 100 itself, an error code corresponding to the failure information, information of the controller 230, a value sensed by the sensing unit 270, a sensing value of the motor, information on a failure of the water supply unit, and information on a failure of the drainage unit.

The usage information may include various types of information, such as the number of times of use of the washing machine 100, a course set by a user, and optional setup information set in the washing machine 100. According to an embodiment, the usage information may include a content inputted to the washing machine 1000 by the user or information initially set in the washing machine 100.

The memory 250 stores information on a reference time for determining a cord-off that will be described below. The reference time refers to a time that serves as a reference for recognizing a cord-off or cutoff of power supply occurring in the washing machine 100. According to an embodiment, the reference time may be defined as one period, two periods, three periods, or more periods of a pulse constituting commercial AC.

For example, assuming that the commercial AC has a frequency of 60 hz and a period of each waveform is 16.7 ms, the reference time may be defined as 16.7 ms, 33 ms, 50 ms, and 67 ms.

And, assuming that the commercial AC has a frequency of 50 hz and a period of each waveform is 20 ms, the reference time may be defined as a multiple of 20 ms, such as 20 ms, 40 ms, and 60 ms.

The cord-off sensing unit 240 detects a pulse of the commercial AC applied to the washing machine 100 and transmits a detected result to the controller 230.

The cord-off sensing unit 240 is positioned at an input terminal of the commercial AC that is shaped as a sign wave and includes a positive (+) pulse and a negative (−) pulse that are alternately repeated. The cord-off sensing unit 240 generates a sensing signal for the commercial AC using one of the positive (+) pulse and the negative (−) pulse at the input terminal of the commercial AC, and transmits the generated sensing signal to the controller 230.

Since the sensing signal is continuously applied to the controller 230 in a constant period (for example, 16.7 ms), the sensing signal may form a pulse train having a constant period (for example, 16.7 ms).

When a pulse provided from the cord-off sensing unit 240 is not inputted within a predetermined reference time, the controller 230 determines that the commercial AC applied to the washing machine 100 is cut off, i.e., that a "cord-off" occurs. When the cord-off occurs in the washing machine 100, the controller 230 opens the door 123 and stops the driving unit 150 driving the washing tub 122 or counter-rotate the washing tub 122 to quickly reduce the rotational force of the washing tub 122.

For user's safety, the controller 230 may reduce the rotational speed of the driving unit 150 to a reference speed (50 RPM to 200 RPM) or less, and then open the door 123.

Further, the controller 230 performs the overall control of the washing machine 100. The controller 230 performs a series of washing courses, such as a washing cycle, a rinsing cycle, and a dehydrating cycle, according to an operation mode set by the input unit 220 and a washing command set by a user. The controller 230 may determine a driving time, a driving speed, and a driving method of the driving unit 150 by referring to the water level, temperature, and amount of laundry of the washing tub 122 or drum through the sensing unit 270. For example, the controller 230 may properly treat the washing course set by the user by referring to a result sensed by the sensing unit 270. According to an embodiment, the controller 230 may adjust valves included in the washing machine 100, which performs water supply or drainage, to be appropriate for each step of the washing process.

In response to a control signal from the controller 230, the display unit 210 displays information inputted by the selecting unit 222 and the manipulating unit 221, operational state information of the washing machine 100, and state information on the completion of operation of the washing machine 100. Further, when the washing machine 100 causes malfunction, the display unit 210 displays failure information on the malfunction on a screen.

The display unit 210 may include an LED, an LCD, and an OLED. However, the present invention is not limited thereto. For example, any devices that emit light to allow a user to feel visual effects may be used for the display unit 210.

In the washing machine 100, the washing tub 122 rotates at high speed when the laundry is washed or dehydrated. When a cord 180 is unplugged to cause the cord-off or power failure occurs while the washing tub 122 rotates at high speed, the door 123 may be opened to allow the laundry to be taken out.

For this purpose, the washing machine 100 may be configured to quickly determine a time point when the cord-off occurs and open the door 123 at the time point.

The commercial AC that is shaped as a sign wave and includes a positive (+) pulse and a negative (−) pulse that are alternately switched may render it difficult to rapidly determine ON/OFF unlike DC. Further, since a voltage of commercial AC is measured as a mean value, such as RMS, rather than the maximum value or minimum value, determining occurrence of the cord-off by simply measuring an input voltage may cause the cord-off to be measured at a time point far later than an actual time point that the cord-off occurs. The cord-off sensing unit 240 that may quickly determine whether the cord-off occurs will be described in greater detail with reference to FIGS. 4 and 5.

Figure 4:
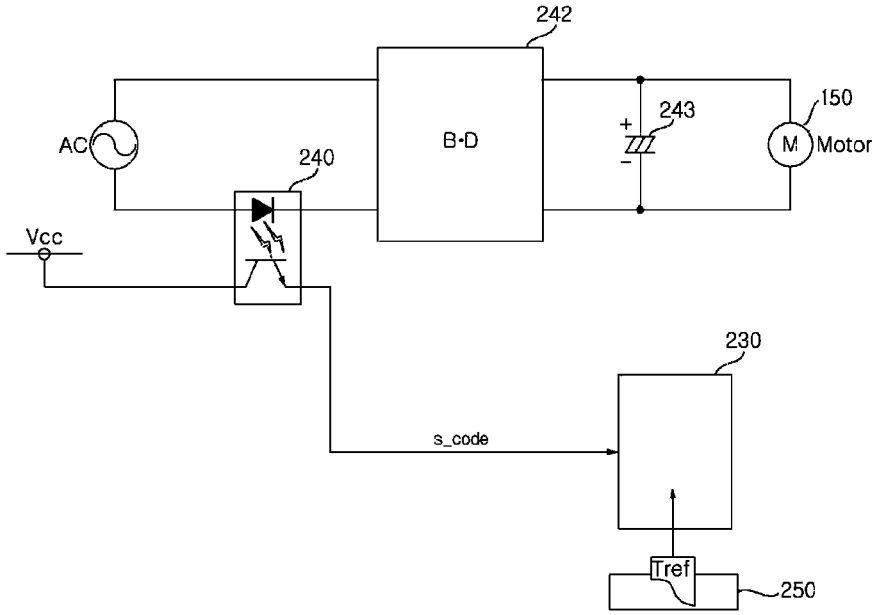
FIG. 4 is a block diagram illustrating a cord-off sensing unit according to an embodiment of the present invention.

FIG. 4 is a block diagram illustrating a cord-off sensing unit according to an embodiment of the present invention.

The cord-off sensing unit 240 may include a photo coupler 241 that is positioned at an input terminal of the commercial AC and connected between a driving voltage source VCC and the controller 230.

The photo coupler 241 becomes conductive between the driving voltage source VCC and the controller 230 when the commercial AC has a positive (+) pulse, and maintains a cuff-off state when the commercial AC has a negative (−) pulse.

As shown in FIG. 4, the driving unit 150 is positioned at an output terminal of a rectifier including a bride diode 242 and a capacitor 243. The driving unit 150 is controlled by the controller 230 to be rotated in a direction or its opposite direction, or turned on/off. When the commercial AC is normally applied to the washing machine 100, the photo coupler 241 generates pulses having a predetermined period, for example, 16.7 ms. The generated pulses are applied to the controller 230. When the number of the pulses applied to the controller 230 does not reach a predetermined number, for example, three or more, the controller 230 determines that the cord-off occurred and controls the driving unit 150 to reduce the rotational speed of the motor and allow the door 123 to be opened so that the user may take the laundry out.

Figure 5:
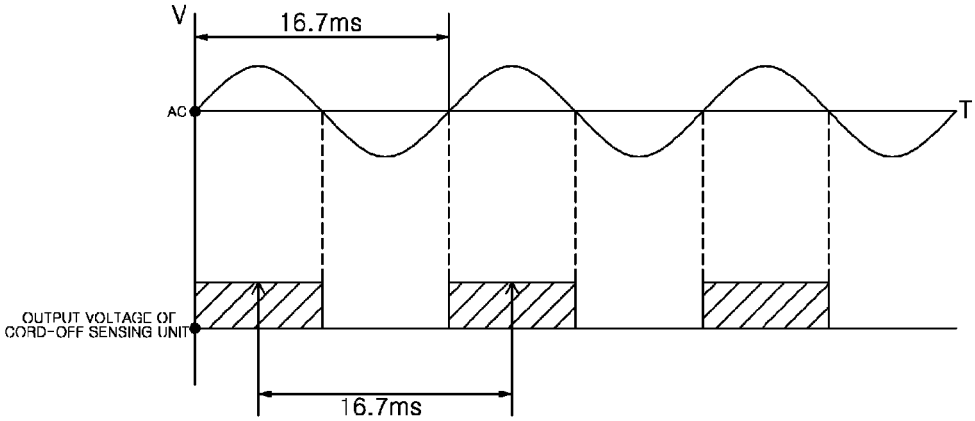
FIG. 5 illustrates a pulse waveform of the commercial AC applied to the washing machine and an output waveform of the cord-off sensing unit.

FIG. 5 illustrates a pulse waveform of the commercial AC applied to the washing machine 100 and an output waveform of the cord-off sensing unit 240.

When the commercial AC has a frequency of 60 hz, the period of a unit pulse is 16.7 ms, and when the commercial AC has a frequency of 50 hz, the period of the unit pulse is 20 ms.

The cord-off sensing unit 240 generates a sensing signal when the commercial AC has a positive (+) pulse. Thus, as shown in FIG. 5, a sensing signal s_code is generated in a predetermined period 16.7 ms to create a pulse train. When the commercial AC is not applied to the washing machine 100, the pulse train stops being created and the controller 230 may determine that a time point when the pulse train stops being created is a time point when a cord-off occurs. However, there also exists a likelihood that one or more sensing signals constituting the pulse train may be left out due to an instant change in voltage of the commercial AC or malfunction of the cord-off sensing unit 240. It might be reasonable to determine that a cord-off occurred when two or three sensing signals are left out rather than when only one sensing signal is left out.

Accordingly, the controller 230 may determine that a cord-off occurred according to the following conditions:

1) Even when a single sensing signal is left out from among sensing signals outputted from the cord-off sensing unit 240, it is determined that a cord-off occurred.

2) When two or more sensing signals are left out from sensing signals outputted from the cord-off sensing unit 240, it may be determined that a cord-off occurred.

Here, the above conditions 1) and 2) have been used to detect occurrence of a cord-off. However, the present invention is not limited thereto. For example, the conditions 1) and 2) may also be used to determine whether a power failure occurred.

When a power failure occurs, no sensing signals s_code are generated, and thus, the conditions 1) and 2) also work in the case of the power failure.

Figure 6:
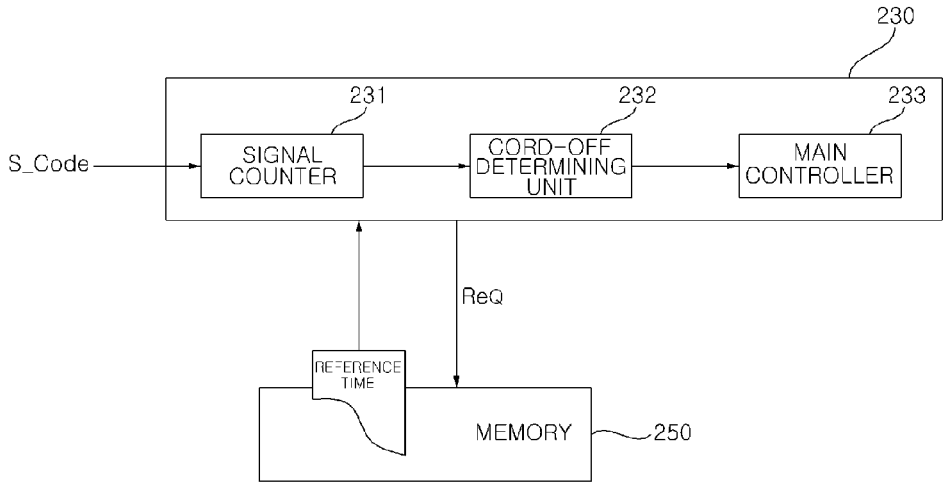
FIG. 6 is a block diagram illustrating the controller shown in FIG. 3.

FIG. 6 is a block diagram illustrating the controller 230 shown in FIG. 3.

The controller 230 includes a signal counter 231, a cord-off determining unit 232, and a main controller 233.

The signal counter 231 determines whether sensing signals s_code generated corresponding to the commercial AC are periodically applied. When a pulse train including the sensing signals s_code stops being created, the signal counter 231 notifies the cord-off determining unit 232 of whether the pulse train stops being created.

Upon receiving from the signal counter 231 that a sensing signal s_code was left out, the cord-off determining unit 232 determines whether a cord-off occurs based on interval data stored in the memory 250. In the case that the omission of a single sensing signal s_code is set to be determined as the occurrence of a cord-off, the cord-off determining unit 232 determines that a cord-off occurred upon receiving the omission of the sensing signal s_code from the signal counter 231.

However, in the case that consecutive omission of a plurality of sensing signals is set to be determined as the occurrence of a cord-off, the cord-off determining unit 232 determines that a cord-off occurred when two or more pulses are consecutively left out.

The commercial AC may have a frequency of 60 hz or 50 hz according to a region using the commercial AC. Accordingly, the period in which the sensing signals s_code are applied to the signal counter 231 varies with the frequency of the commercial AC. In the case that the omission of two or more sensing signals s_code are determined as occurrence of a cord-off, the occurrence of the cord-off needs to be determined based on a time corresponding the number of the omitted sensing signals s_code. Accordingly, the cord-off determining unit 232 may include information on a reference time that serves as a reference for determining whether a cord-off occurs. The reference time may be set up in the cord-off determining unit 232 itself or stored in the memory 250.

The invention has been explained above with reference to exemplary embodiments. It will be evident to those skilled in the art that various modifications may be made thereto without departing from the broader spirit and scope of the invention. Further, although the invention has been described in the context its implementation in particular environments and for particular applications, those skilled in the art will recognize that the present invention's usefulness is not limited thereto and that the invention can be beneficially utilized in any number of environments and implementations. The foregoing description and drawings are, accordingly, to be regarded in an illustrative rather than a restrictive sense.

What is claimed is:

1. A home appliance of treating laundry contained in a washing tub, comprising:

a cord-off sensing unit that generates a pulse train in response to a constant polarity half of a commercial AC wave, the pulse train including a plurality of pulses, each of the pulses being generated during a half cycle time of the commercial AC wave;

a controller that receives the pulse train and determines whether a cord-off occurs, wherein the controller comprises:

a counter detecting a stop of an input of the pulse train; and a cord-off determining unit determining that the cord-off occurs when a reference time has elapsed since the input of the pulse train stopped.

2. The home appliance of claim 1, wherein the cord-off sensing unit includes a photo coupler that switches ON/OFF according to the constant polarity half of the commercial AC wave.

3. The home appliance of claim 2, wherein the photo coupler generates the pulse during the half cycle time of the commercial AC wave.

4. The home appliance of claim 1, wherein the reference time is equal to a cycle time of the commercial AC wave.

5. The home appliance of claim 1, wherein the reference time is equal to two or more times a cycle time of the commercial AC wave.

6. The home appliance of claim 1, wherein the controller controls a door of the washing tub to be open when the cord-off occurs.

7. The home appliance of claim 1, wherein the controller controls a rotational speed of the washing tub to be reduced when the cord-off occurs.

8. The home appliance of claim 1, wherein the controller controls a rotational speed of the washing tub to be reduced to a predetermined speed and then controls a door of the washing tub to be open when the cord-off occurs.

9. The home appliance of claim 1, wherein the controller controls the washing tub to be counter-rotated to reduce a rotational speed of the washing tub when the cord-off occurs.

* * * * *